US009167636B2

(12) United States Patent
Jin et al.

(10) Patent No.: US 9,167,636 B2
(45) Date of Patent: Oct. 20, 2015

(54) VARIABLE LIGHTING APPARATUS

(75) Inventors: Joong Hun Jin, Masan-si (KR); Min Ho Cha, Seoul (KR)

(73) Assignee: SAMSUNG ELECTRONICS CO., LTD., Suwon-Si, Gyeonggi-Do (KR)

( * ) Notice: Subject to any disclaimer, the term of this patent is extended or adjusted under 35 U.S.C. 154(b) by 112 days.

(21) Appl. No.: 13/480,928

(22) Filed: May 25, 2012

(65) Prior Publication Data

US 2012/0300451 A1 Nov. 29, 2012

(30) Foreign Application Priority Data

May 26, 2011 (KR) ..... 10-2011-0050076

(51) Int. Cl.

| | |
|---|---|
| ***F21S 8/08*** | (2006.01) |
| ***F21S 13/10*** | (2006.01) |
| ***H05B 33/08*** | (2006.01) |
| ***F21V 23/06*** | (2006.01) |
| ***F21V 17/00*** | (2006.01) |

(Continued)

(52) U.S. Cl.

CPC ..... *H05B 33/0803* (2013.01); *F21V 17/002* (2013.01); *F21V 21/00* (2013.01); *F21V 21/06* (2013.01); *F21V 23/06* (2013.01); *F21S 6/00* (2013.01); *F21S 8/033* (2013.01); *F21S 8/04* (2013.01); *F21V 17/02* (2013.01); *F21V 21/14* (2013.01); *F21W 2131/103* (2013.01); *F21Y 2101/02* (2013.01)

(58) Field of Classification Search

CPC ... F21V 17/002; F21V 21/002; F21V 21/005; F21S 2/005

USPC ..... 362/413, 433, 418, 419, 430, 431, 457, 362/458, 563, 564, 123, 806

See application file for complete search history.

(56) References Cited

U.S. PATENT DOCUMENTS 2,414,866 A * 1/1947 Glaser ..... 362/410
3,840,842 A * 10/1974 Gabryelewicz ..... 439/639

(Continued)

FOREIGN PATENT DOCUMENTS

DE 102009039748 A1 8/2010
JP 2010-218931 9/2010

(Continued)

OTHER PUBLICATIONS

Extended European Search Report issued in European Patent Application No. 12168598.6 dated Sep. 12, 2012.

*Primary Examiner* — Jong-Suk (James) Lee
*Assistant Examiner* — Erin Kryukova
(74) *Attorney, Agent, or Firm* — McDermott Will & Emery LLP

(57) ABSTRACT

Provided is a variable lighting apparatus that may include a lighting unit to emit light and including a plurality of connection end portions extending in different directions and at different angels, a supporting unit selectively connected with one of the plurality of connection end portions of the lighting unit to support the lighting unit, and to provide power to the connected lighting unit based on a contact point connection scheme. At least one of a light angle, a light direction, an elevation of light, and an amount of light associated with light emitted from the lighting unit varies based on a change in a state of connections between the plurality of connections portions and the supporting unit. The variable lighting apparatus may readily vary a lighting condition by changing a state of a connection between the lighting unit and the supporting unit.

3 Claims, 7 Drawing Sheets

(51) Int. Cl.

| | |
|---|---|
| ***F21V 21/00*** | (2006.01) |
| ***F21V 21/06*** | (2006.01) |
| *F21V 21/14* | (2006.01) |
| *F21S 6/00* | (2006.01) |
| *F21S 8/00* | (2006.01) |
| *F21S 8/04* | (2006.01) |
| *F21V 17/02* | (2006.01) |
| *F21W 131/103* | (2006.01) |
| *F21Y 101/02* | (2006.01) |

(56) References Cited

U.S. PATENT DOCUMENTS

| | | | | |
|---|---|---|---|---|
| 3,970,834 | A * | 7/1976 | Smith | 362/123 |
| 4,053,761 | A * | 10/1977 | Brinkley | 362/413 |
| 4,161,768 | A * | 7/1979 | Gauthier et al. | 362/123 |
| 4,298,907 | A * | 11/1981 | Holt, Jr. | 362/4 |
| 5,559,681 | A * | 9/1996 | Duarte | 362/231 |
| 5,609,412 | A * | 3/1997 | Contigiani | 362/249.08 |
| 5,695,279 | A * | 12/1997 | Sonnleitner et al. | 362/419 |
| 6,017,142 | A * | 1/2000 | Harris, Jr. | 362/564 |
| 6,210,189 | B1 * | 4/2001 | Gantt | 439/214 |
| 6,340,233 | B1 * | 1/2002 | Shieh | 362/102 |
| 6,422,891 | B1 * | 7/2002 | Huang | 439/367 |
| 6,883,951 | B2 * | 4/2005 | Wu | 362/565 |
| 7,073,932 | B2 * | 7/2006 | Wainwright | 362/565 |
| 7,270,450 | B2 * | 9/2007 | Chan | 362/398 |
| 7,547,126 | B2 * | 6/2009 | Hiratsuka | 362/413 |
| 7,559,666 | B2 * | 7/2009 | Liu | 362/123 |
| 8,026,671 | B2 * | 9/2011 | Ku | 315/185 R |
| 8,029,154 | B2 * | 10/2011 | Myer | 362/145 |
| 8,047,682 | B2 * | 11/2011 | Zheng et al. | 362/249.05 |
| 8,062,718 | B2 * | 11/2011 | Schooley | 428/20 |
| 8,104,925 | B2 * | 1/2012 | Gordin | 362/259 |
| 8,408,733 | B2 * | 4/2013 | Nelson et al. | 362/197 |
| 8,439,534 | B1 * | 5/2013 | Roe et al. | 362/486 |
| 8,454,201 | B2 * | 6/2013 | Cohen | 362/285 |
| 2002/0186561 | A1 * | 12/2002 | Giudicelli | 362/249 |
| 2009/0267533 | A1 * | 10/2009 | Lee | 315/294 |
| 2010/0271804 | A1 * | 10/2010 | Levine | 362/35 |
| 2011/0216539 | A1 * | 9/2011 | Yuan | 362/249.1 |
| 2011/0263177 | A1 * | 10/2011 | Lemchen | 446/87 |
| 2012/0140474 | A1 * | 6/2012 | Jurik et al. | 362/249.09 |
| 2013/0163235 | A1 * | 6/2013 | Chuang | 362/190 |

FOREIGN PATENT DOCUMENTS

| | | | |
|---|---|---|---|
| KR | 10-0990472 | B1 | 10/2010 |
| WO | WO-2009/143650 | A1 | 12/2009 |

* cited by examiner

VARIABLE LIGHTING APPARATUS

CROSS-REFERENCE TO RELATED APPLICATION

This application claims the benefit of Korean Patent Application No. 10-2011-0050076, filed on May 26, 2011, in the Korean Intellectual Property Office, the disclosure of which is incorporated herein by reference.

BACKGROUND

1. Field of the Invention

The present invention relates to a variable lighting apparatus that changes a lighting environment based on various conditions, and more particularly, to a variable lighting apparatus that readily changes a light angle, a light direction, an amount of light, and the like based on a connection posture with a supporting device that provides power.

2. Description of the Related Art

A lighting device is installed in indoor space or outdoor space to brighten a dark environment. The lighting device may be classified as a fixed type that is fixed at a predetermined location in an indoor space or an outdoor space, such as a street light, a ceiling light, and a wall light, and as a non-fixed type a location of which is adjusted by a user, such as a desk lamp and the like.

The lighting device may be classified into various types, based on an intended purpose, including lightings for indoor spaces or outdoor spaces, sub-lightings having a relatively low illumination, such as a mood lamp and the like, downlights for a predetermined space such as a kitchen, an entrance, and a porch.

The lighting device is manufactured for a predetermined purpose and the purpose can not be changed while the lighting device is in use. That is, the lighting device is manufactured for one purpose and thus, may not be able to be used for another purpose. Therefore, there is a need of a lighting device adaptable for various purposes.

SUMMARY

An aspect of the present invention provides a variable lighting apparatus that readily changes a lighting condition while in use, and thus the variable lighting apparatus may be used for various purposes.

According to an aspect of the present invention, there is provided a variable lighting apparatus, the apparatus including a lighting unit to emit light, and a supporting unit selectively connected with the lighting unit to support the lighting unit, and to provide power to the connected lighting unit, and the lighting unit changes a lighting condition through changing a connection posture with respect to the supporting unit.

The lighting unit may include at least one light emitting diode (LED) and a plurality of contact point portions connected with the supporting unit based on a contact point connection scheme.

The supporting unit may include a supporting recess to which a portion of the lighting unit is inserted, and a power providing portion formed in the supporting recess may be connected with the lighting unit inserted into the supporting recess, based on a contact point connection scheme, to provide power to the lighting unit.

The lighting unit may include a body including a plurality of connection end portions that extend in different directions, at different angles, and to different lengths, and that have contact points for connecting with the supporting portion, respectively, and at least one light emitting member mounted on the body and varying at least one of a light angle, a light direction, an elevation of light, and an amount of light based on a connection between one of the plurality of connection end portions and the supporting unit.

The lighting unit may include a body including a plurality of connection end portions that extend to the same length, in different directions, and at different angles, and that have contact points for connecting with the supporting unit, respectively, and a plurality of light emitting members mounted on the body, to independently emit different amounts of light based on a corresponding connection between the plurality of connection end portions and the supporting unit.

The lighting unit may include a body including a first connection end portion including a first contact point for connecting with the supporting unit, and a second connection end portion that extends from the first connection end portion in a curve and includes a second contact point for connecting with the supporting unit, and at least one light emitting portion mounted on the body to emit the same amount of light or a plurality of light emitting members mounted on the body to emit different amounts of light.

The lighting unit may include a body including a first connection end portion including a first contact point for connecting with the supporting unit, a second connection end portion that extends in a different direction and at a different angle from the first connection end portion and includes a second contact portion for connecting with the supporting unit, and a third connection end portion that extends in a different direction and at a different angle from the first connection end portion and the second connection end portion and includes a third contact portion for connecting with the supporting unit, and a first light emitting portion, a second light emitting portion, and a third light emitting portion mounted on the first connection end portion, the second connection end portion, and the third connection end portion, respectively, to independently emit light based on power provided from the first contact point, the second contact point, and the third contact point respectively.

According to another aspect of the present invention, there is provided a variable lighting apparatus, the apparatus including a lighting unit configured to emit light, and comprising a plurality of connection end portions that extend in different directions and at different angles, and a supporting unit selectively connected with one of a plurality of connection end portions of the lighting unit to support the lighting unit, and providing power through connecting with the lighting unit based on a contact point connection scheme, and at least one of a light angle, a light direction, an elevation of light, and an amount of light associated with light emitted from the lighting unit varies based on a change in a state of connections between the plurality of connection portions and the supporting unit.

The plurality of connection end portions may have different lengths.

The plurality of connection end portions may extend to be inclined with respect to the body or extend in a curve.

The lighting unit may include at least one light emitting member having the same amount of light, or a plurality of light emitting members having different amounts of light and configured to emit light, independently, based on a corresponding connection between the plurality of connection end portions and the supporting unit.

The lighting unit may include at least one light emitting diode (LED).

The supporting unit may include a supporting recess to which one of the plurality of connection end portions is inserted, and a power providing portion may be included in the supporting recess and may provide power through connecting with one of the plurality of connection end portions based on a contact point connection scheme.

The variable lighting apparatus may further include a fixing portion to fix a posture of the lighting unit on the supporting unit.

Additional aspects, features, and/or advantages of the invention will be set forth in part in the description which follows and, in part, will be apparent from the description, or may be learned by practice of the invention.

BRIEF DESCRIPTION OF THE DRAWINGS

These and/or other aspects, features, and advantages of the invention will become apparent and more readily appreciated from the following description of embodiments, taken in conjunction with the accompanying drawings of which.

DETAILED DESCRIPTION

Figure 1:
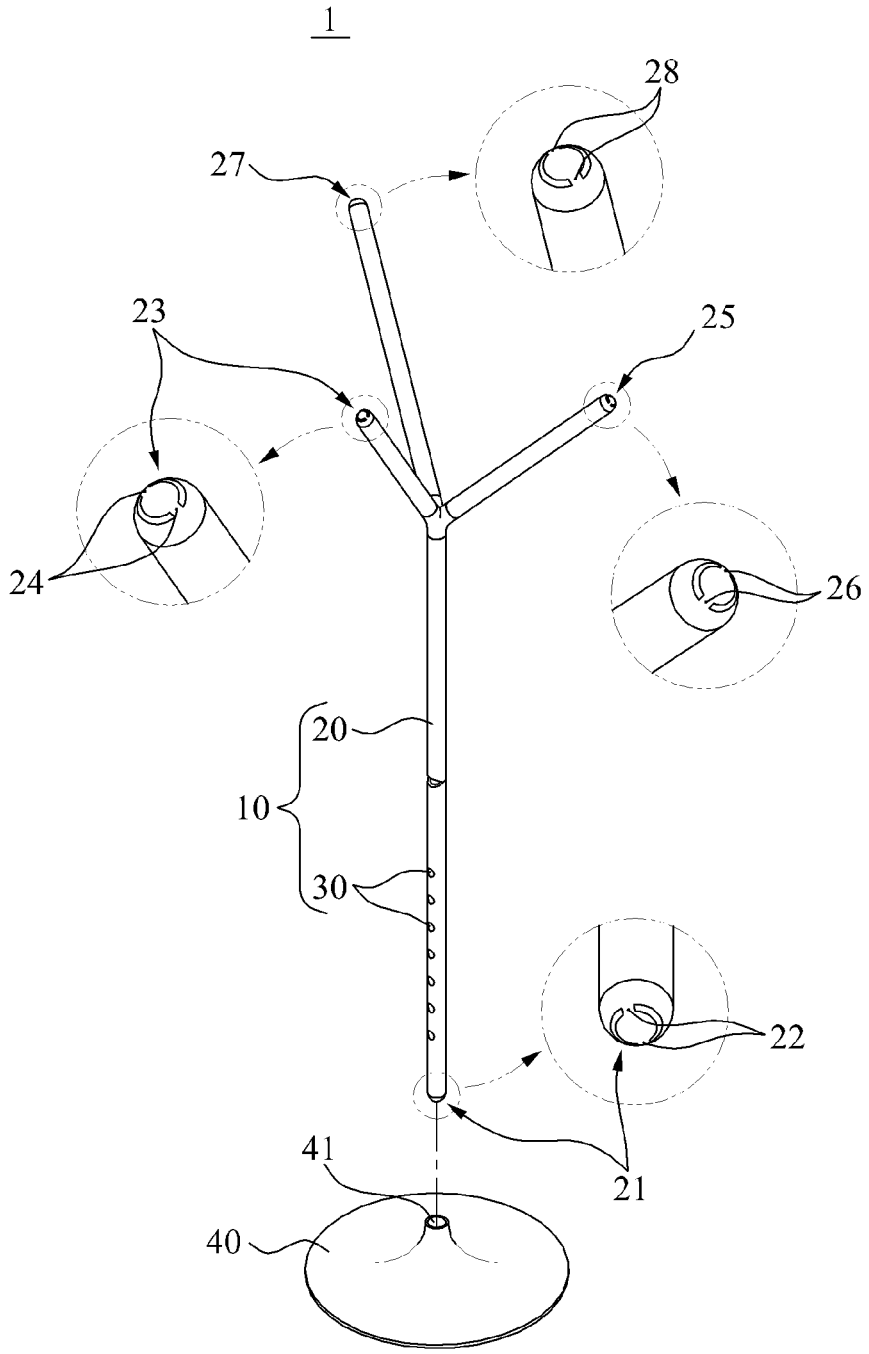
FIG. 1 is a perspective view of a variable lighting apparatus according to an embodiment of the present invention.

Reference will now be made in detail to embodiments of the present invention, examples of which are illustrated in the accompanying drawings, wherein like reference numerals refer to the like elements throughout. Embodiments are described below to explain the present invention by referring to the figures.

FIG. 1 illustrates a variable lighting apparatus 1 according to an embodiment of the present invention.

Referring to FIG. 1, the variable lighting apparatus 1 includes a lighting unit 10 and a supporting unit 40.

Here, the lighting unit 10 may emit light. For example, the lighting unit 10 changes a lighting condition, such as a light angle, a light direction, an elevation of light, an amount of light, and the like, based on a change in a connection posture with the supporting unit 40. The lighting unit 10 may include a body 20 and at least one light emitting member 30.

The body 20 may include a plurality of connection end portions 21, 23, 25, and 27 that extend in different angles and different directions, respectively. The plurality of connection end portions 21, 23, 25, and 27 may include a first connection end portion 21 that extends from one end of the body 20 in one direction, and a second connection end portion 23, a third connection end portion 25, and a fourth connection end portion 27 that extend, from the other end of the body 20, in different directions and at different angles, respectively. In this example, the first connection end portion 21, the second connection end portion 23, the third connection end portion 25, and the fourth connection end portion 27 may extend from the body 20 to different lengths.

The first connection end portion 21 may include a first contact point 22, the second connection end portion 23 may include a second contact point 24, the third connection end portion 25 may include a third contact point 26, and the fourth connection end portion 27 may include a fourth contact point 28. The first through fourth contact points 22, 24, 26, 28 may include positive poles and negative poles, respectively, and may be electrically connected with the supporting unit 40 based on a contact point-connection scheme.

Although not illustrated in detail, the body 20 may be configured to be hinged using a hinge so that a posture is changeable, which will be described with reference to FIG. 3.

The at least one light emitting member 30 may be mounted the body 20. According to the present embodiment, the at least one light emitting member 30 may be mounted on one position close to the first connection end portion 21 of the body 20. In this example, a light angle, a light direction, and an elevation of light associated with light emitted from the at least one light emitting member 30 may be adjusted based on a change in a state of a connection between the supporting unit 40 and one of the first connection end portion 21, the second connection end portion 23, the third connection end portion 25, and the fourth connection end portion 27, as illustrated in FIGS. 2 through 5. Adjusting of the light angle, the light direction, and the height of light of the at least one light emitting member 30 will be described in detail.

For example, the at least one light emitting member 30 may include a light emitting diode (LED) that is economical, since the LED consumes low power, has a long lifespan, and is eco-friendly.

The supporting unit 40 may be selectively connected with the lighting unit 10 to support the lighting unit 10 and to provide power. The supporting unit 40 may include a supporting recess 41 to which a portion of the lighting unit 10 is inserted. A power providing portion that is connected with the lighting unit 10 and provides power may be included in the supporting recess 41. The power providing portion will be described with reference to FIG. 2. In this example, the power providing portion may be connected with a contact point included in a connection end portion, for example, the contact point 22 included in the first connection end portion 21, the contact point 24 included in the second connection end portion 23, the contact point 26 included in the third connection end portion 25, and the contact point 28 included in the fourth connection end portion 27. Accordingly, the power providing portion may have a positive pole and a negative pole corresponding to the first through the fourth contact points 22, 24, 26, and 28.

For example, the supporting unit 40 may be mounted in a predetermined area, such as a desk and the like, based on a non-fixing scheme, so as to support the lighting unit 10, or may be fixed on an indoor wall, so as to support the supporting unit 40.

A lighting method of the variable lighting apparatus 1 according to an embodiment of the present invention will be described with reference to FIGS. 2 through 5.

Figure 2:
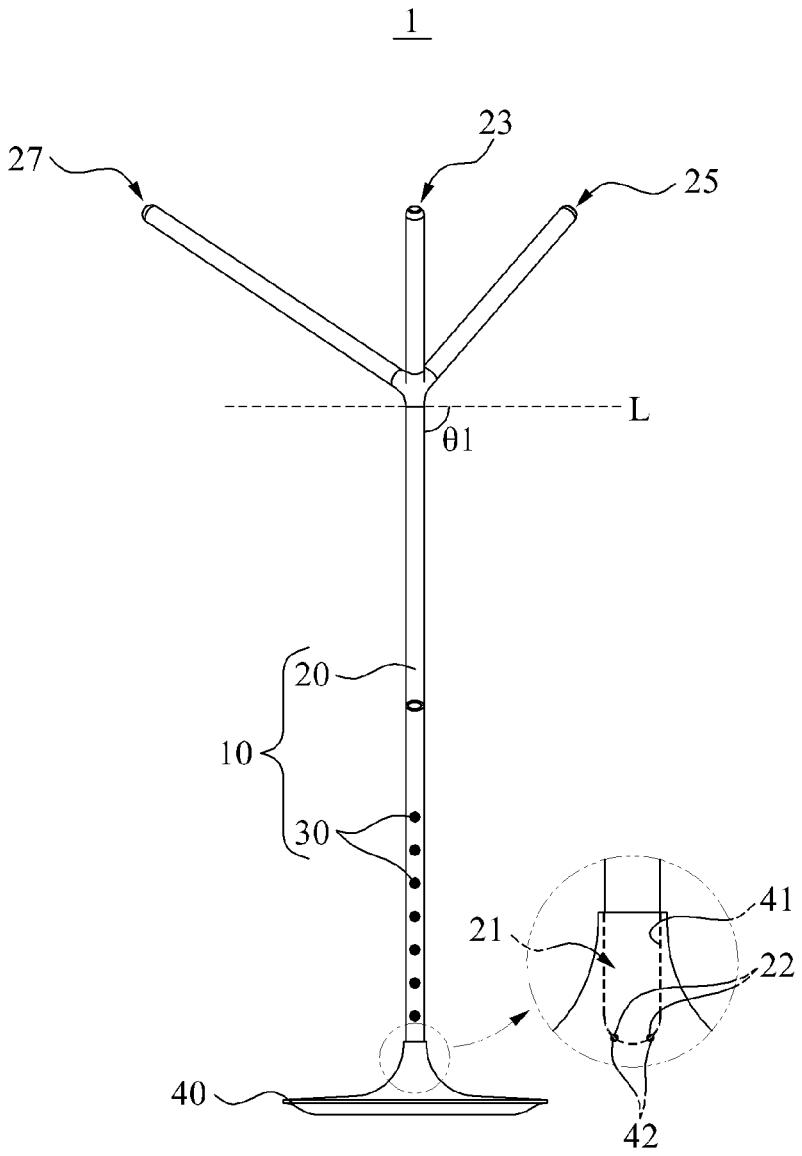
FIG. 2 is a side view of a connection between a first connection end portion of the variable lighting apparatus of FIG. 1 and a supporting unit according to an embodiment of the present invention.
Figure 4:
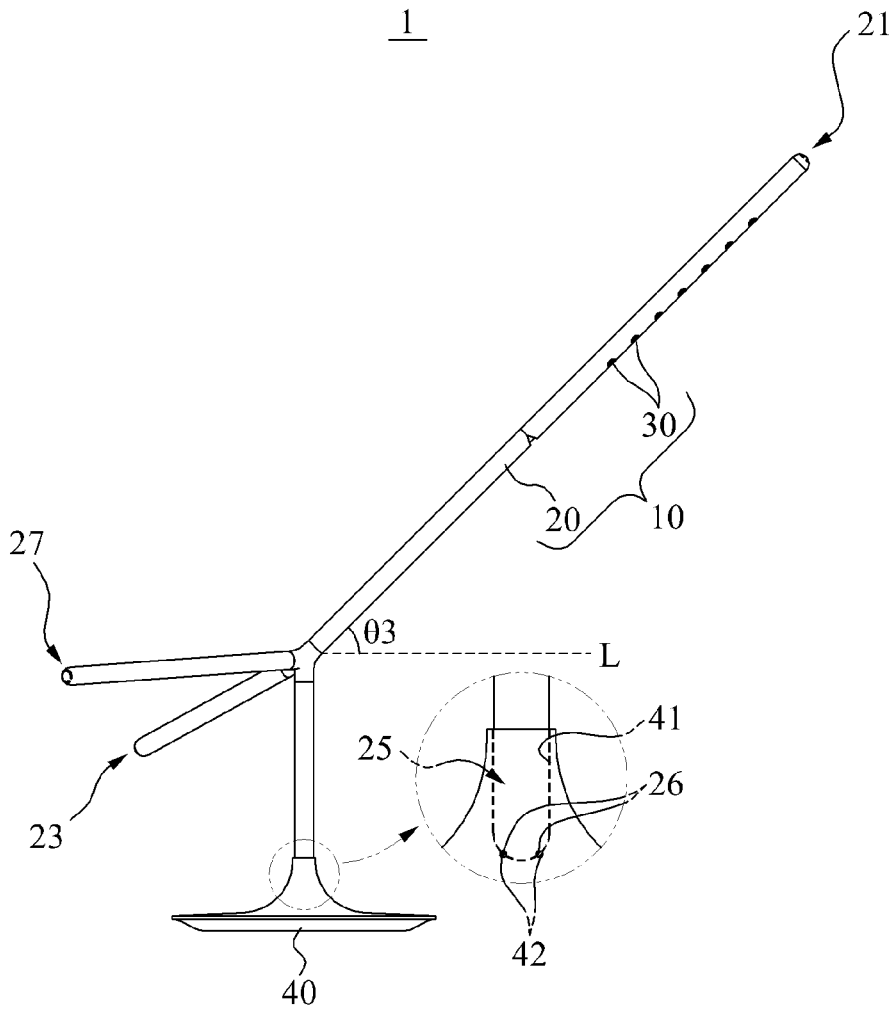
FIG. 4 is a side view of a connection between a third connection end portion of the variable lighting apparatus of FIG. 1 and a supporting unit according to an embodiment of the present invention.
Figure 5:
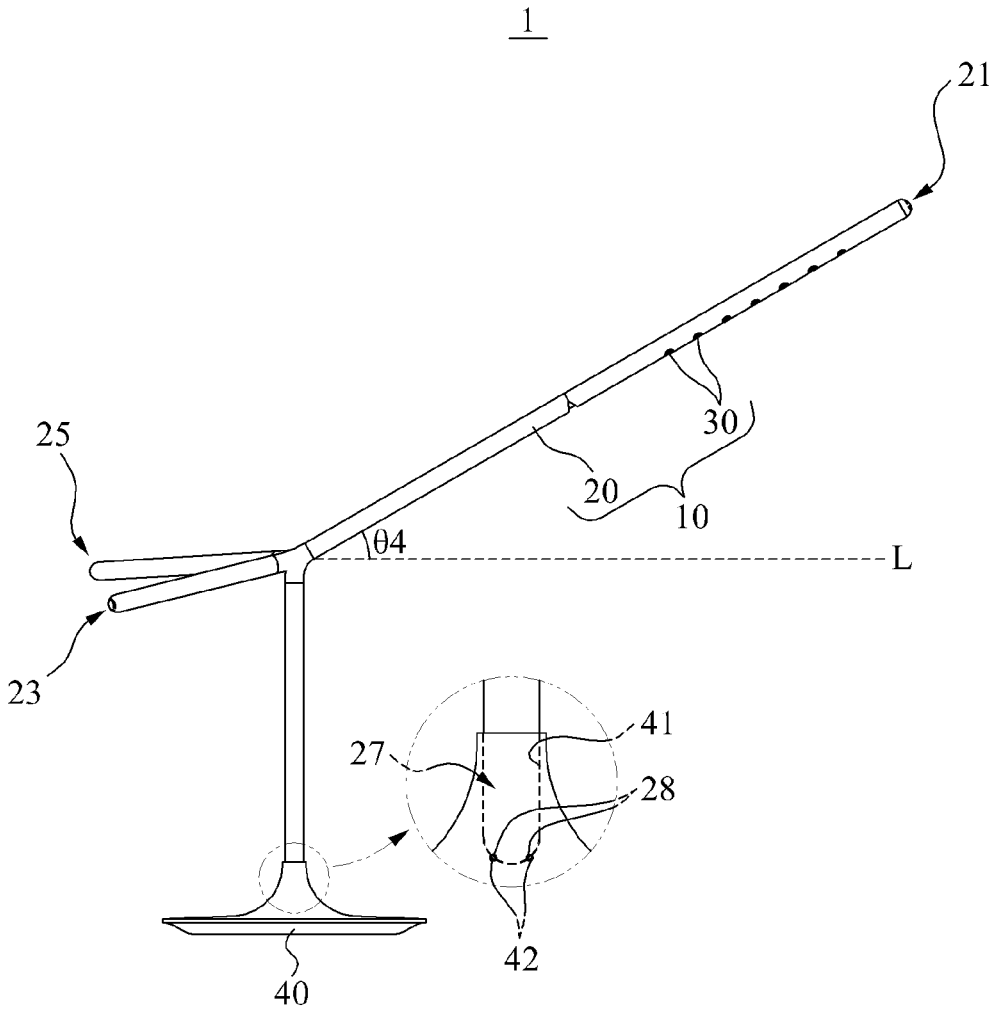
FIG. 5 is a side view of a connection between a fourth connection end portion of the variable lighting apparatus of FIG. 1 and a supporting unit according to an embodiment of the present invention.

FIG. 2 illustrates a connection between a first connection end portion of the variable lighting apparatus of FIG. 1 and a supporting unit according to an embodiment of the present invention. FIG. 3 illustrates a connection between a second connection end portion of the variable lighting apparatus of FIG. 1 and a supporting unit according to an embodiment of the present invention. FIG. 4 illustrates a connection between a third connection end portion of the variable lighting apparatus of FIG. 1 and a supporting unit according to an embodiment of the present invention. FIG. 5 illustrates a connection between a fourth connection end portion of the variable lighting apparatus of FIG. 1 and a supporting unit according to an embodiment of the present invention Referring to FIG. 2, the first connection end portion 21 of the lighting unit 10 is inserted into the supporting recess 41 of the supporting unit 40. In this example, the first connection end portion 21 may be connected with the supporting unit 40 at an angle of 90 degrees (θ1) with respect to a standard line L that is horizontal with respect to a mounting surface on which the supporting unit 40 is mounted.

When the first contact point 22 included in the first connection end portion 21 is electrically connected with a power providing portion 42 inside the supporting recess 41, the at least one light emitting member 30 may emit light at a position close to the supporting unit 40, that is, at a relatively lower portion of the body 20. In this example, the at least one light emitting member 30 emits light from the lower portion of the body 20, so that the variable lighting apparatus 1 may provide a function of a mood lamp.

Figure 3:
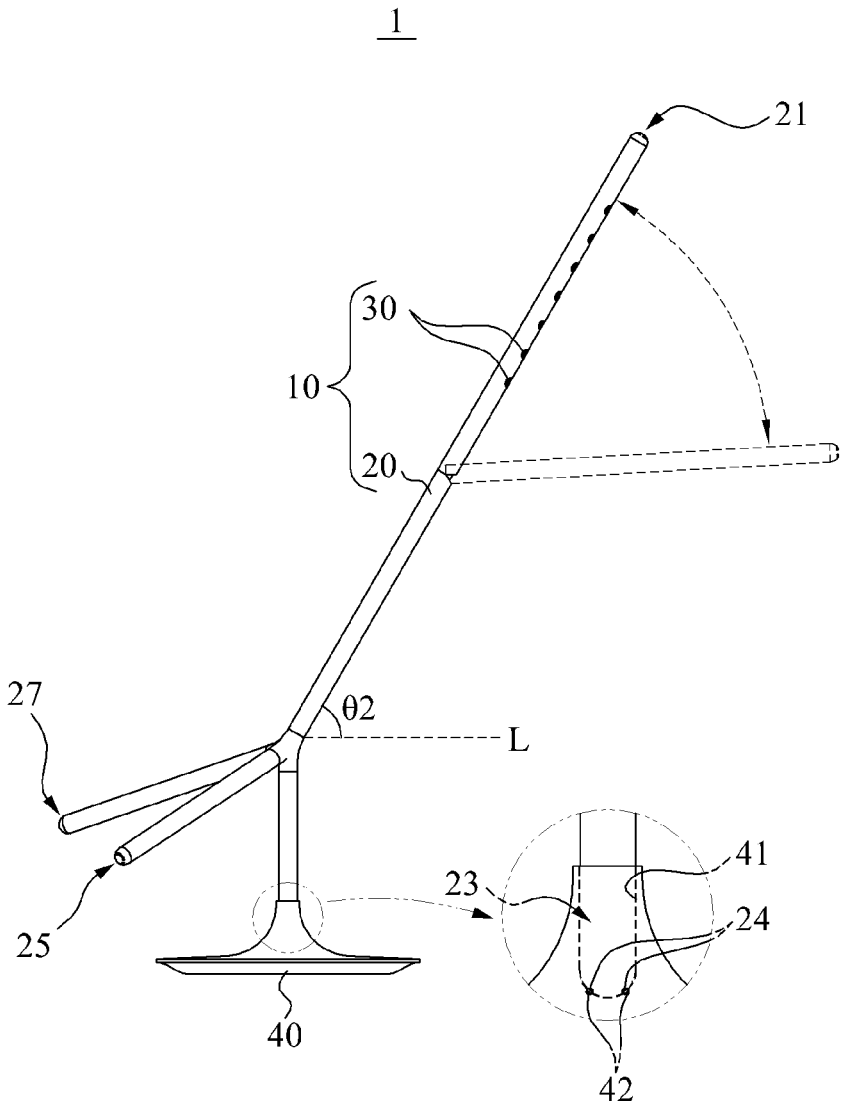
FIG. 3 is a side view of a connection between a second connection end portion of the variable lighting apparatus of FIG. 1 and a supporting unit according to an embodiment of the present invention.

Referring to FIG. 3, the second connection end portion 23 of the lighting unit 10 is inserted into the supporting recess 41 of the supporting unit 40. When the second connection end portion 23 is connected with the supporting unit 40, the second contact point 24 included in the second connection end portion 23 may be connected with the power providing portion 42 inside the supporting recess 41 so that the at least one light emitting member 30 may emit light. In this example, when the second connection end portion 23 is connected with the supporting unit 40, the body 20 including the at least one light emitting member 30 may be inclined at an angle of 60 degrees (θ2) with respect to the standard line L. Accordingly, the at least one light emitting member 30 may emit light at a relatively upper portion of the body 20 at θ2 with respect to the standard line L. Therefore, the variable lighting apparatus 1 may provide a function of a desk lamp.

Referring to FIG. 4, when the third connection end portion 25 of the lighting unit 10 is inserted into the supporting recess 41 of the supporting unit 40, the third contact point 26 of the third connection end portion 25 may be connected with the power providing portion 42 inside the supporting recess 41. The body 20 may be inclined at an angle of 45 degrees (θ3) with respect to the standard line L and may support the at least one light emitting member 30, so that the at least one light emitting member 30 may emit light at θ3 with respect to the standard line L. Accordingly, the at least one light emitting member 30 may emit light at a relatively upper portion of the body 20 so that the variable lighting apparatus 1 may provide a function of a desk lamp.

Referring to FIG. 5, by changing a posture of the lighting unit 10, the fourth connection end portion 27 is inserted into the supporting recess 41 of the supporting unit 40, and a fourth contact point 28 of the fourth connection end portion 27 is electrically connected with the power providing portion 42. In this example, the body 20 may be inclined at an angle of 30 degrees (θ4) and supports the at least one light emitting member 30. Accordingly, the at least one light emitting member 30 may emit light at θ4 with respect to the standard line L at a relatively upper portion of the body 20 so that the variable lighting apparatus 1 may provide a function of a desk lamp.

A light angle associated with light emitted from the at least one light emitting member 30 of the lighting unit 10 may vary based on a change in a connection posture of the lighting unit 10 with the supporting unit 40. In addition, based on a change in a posture of the lighting unit 10, an angle, for example, θ1, θ2, θ3, and θ4, at which the lighting unit 10 supports the at least one light emitting member 30 may vary, and a length extending from the body 20 may vary, so that a light direction and an elevation of light of the at least one light emitting member 30 may vary.

Figure 6:
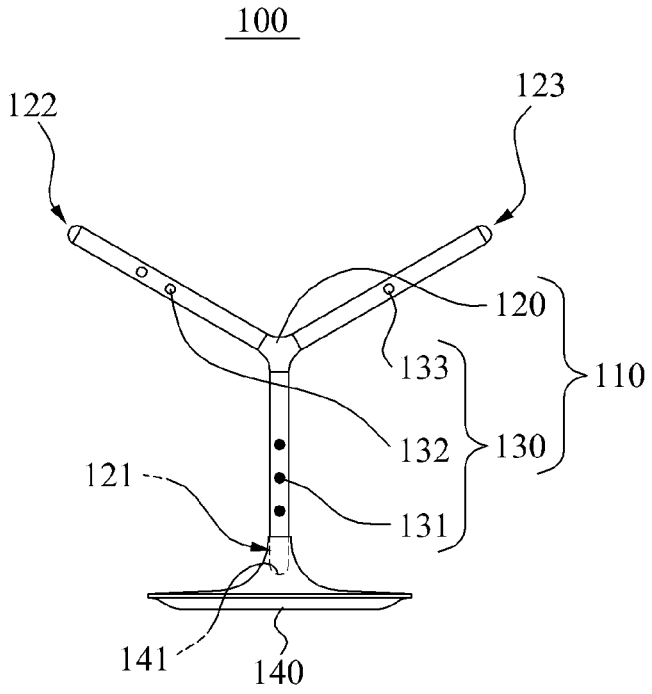
FIG. 6 is a side view of a variable lighting apparatus according to another embodiment of the present invention.

FIG. 6 illustrates a variable lighting apparatus 100 according to another embodiment of the present invention.

Referring to FIG. 6, the variable lighting apparatus 100 includes a lighting unit 110 and a supporting unit 140.

The lighting unit 110 may include a body 120 and a plurality of light emitting members 130 mounted on the body 120. In this example, the body 120 may include a first connection end portion 121, a second connection end portion 122, and a third connection end portion 123, that extend to be inclined in different directions, respectively. Although not illustrated, the first connection end portion 121, the second connection end portion 122, and the third connection end portion 123 include a first contact point, a second contact point, and a third contact point, respectively.

Referring to FIG. 6, the first connection end portion 121, the second connection end portion 122, and the third connection end portion 123 extend in different directions from the body 120, and extend to be inclined at the same angle. Also, lengths of the first connection end portion 121, the second connection end portion 122, and the third connection end portion 123 extending from the body 120 may be the same. Here, the configuration may not limited thereto. The angle inclined with respect to the body 120 or the length of the first connection end portion 121, the second connection end portion 122, and the third connection end portion 123 may be changed in various ways.

The plurality of light emitting members 130 may include a first light emitting portion 131 mounted close to the first connection end portion 121, a second light emitting portion 132 mounted close to the second connection end portion 122, and a third light emitting portion 133 mounted close to the third connection end portion 123. Here, the first light emitting portion 131, the second light emitting portion 132, and the third light emitting portion 133 are configured to emit different amounts of light as illustrated in FIG. 6. The first light emitting portion 131 may be configured to emit a relatively greater amount of light than the second light emitting portion 132 and the third light emitting portion 133, and the third light emitting portion 133 may be configured to emit a relatively smaller amount of light than the first light emitting portion 131 and the second light emitting portion 132. In this example, the amount of light emitted from the first light emitting portion 131, the second light emitting portion 132, and the third light emitting portion 133 may not be limited as illustrated in FIG. 6, and may be changed in various ways.

The first light emitting portion 131 may emit light when the first connection end portion 121 is connected with the supporting unit 140, the second light emitting portion 132 may emit light when the second connection end portion 122 is connected with the supporting unit 130, and the third light emitting portion 133 may emit light when the third connection end portion 123 is connected with the supporting unit 140. A lighting operation of the plurality of light emitting members 130 corresponding to the first light emitting portion 131, the second light emitting portion 132, and the third light emitting portion 133, will be described in detail.

The supporting unit 140 may include a supporting recess 141 to which the first connection end portion 121, the second connection end portion 122, and the third connection end portion 133 of the body 120 are selectively inserted, so as to support the body 120. Since the supporting unit 140 has the same configuration as the supporting unit 40 described with reference to FIGS. 1 through 5, detailed descriptions thereof will be omitted.

In the variable lighting apparatus 100 configured as described in the foregoing, the first connection end portion 121 of the body 120 may be inserted into the supporting recess 141 of the supporting unit 140, the first light emitting portion 131 mounted close to the first connection end portion 121 may emit light. In this example, the second light emitting portion 132 and the third light emitting portion 133 included in the second connection end portion 122 and the third connection end portion 123 may not emit light. A first contact point (not illustrated) included in the first connection end portion 121 may be connected with a power providing portion (not illustrated) inside the supporting recess 141, so that the first light emitting portion 141 may operate.

In the same manner as the lighting operation of the first light emitting portion 131, when the second connection end portion 122 is connected with the supporting unit 140, the second light emitting portion 132 may emit light. Also, when the third connection end portion 123 is connected with the supporting unit 140, the third light emitting portion 133 may emit light. Accordingly, the user may change a connection posture between the body 120 of the lighting unit 110 with the supporting unit 140 based on a desired amount of light and thus, may readily change the amount of light emitted from the plurality of light emitting members 130 to the desired amount of light.

Figure 7:
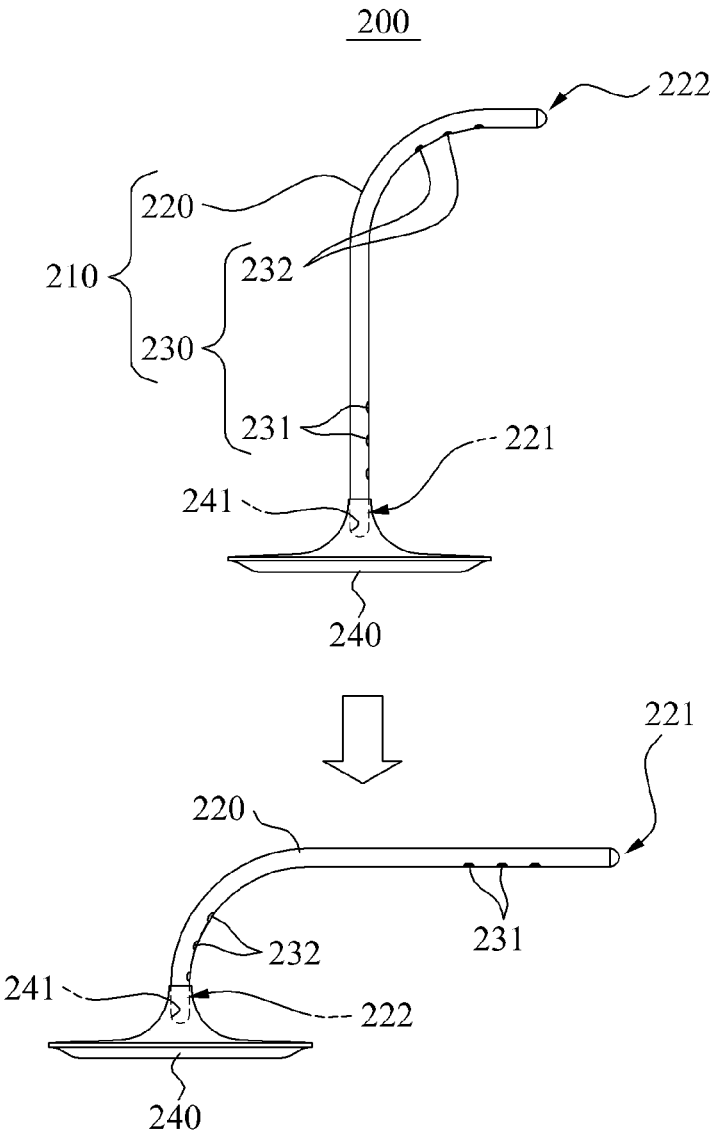
FIG. 7 is a side view of a variable lighting apparatus according to still another embodiment of the present invention.

FIG. 7 illustrates a variable lighting apparatus 200 according to still another embodiment of the present invention.

Referring to FIG. 7, the variable lighting apparatus 200 includes a lighting unit 210 and a supporting unit 24.

The lighting unit 210 may include a body 220 and a plurality of light emitting members 230. Here, the body 220 may include a first connection end portion 221, and a second connection end portion 222 that extends from the first end connection end portion 221 in a curve. Although not illustrated, the first connection end portion 221 may include a first contact point and the second connection end portion 222 may include a second contact point. The configurations of the first contact point and the second contact point are similar to the contact points illustrated in FIG. 1 and thus, detailed descriptions thereof will be omitted.

The plurality light emitting members 230 may be mounted on the body 220, and the may include a first light emitting portion 231 mounted on a side of the first connection end portion 221 and a second light emitting portion 232 mounted on a side of the second connection end portion 222. Even though the first light emitting portion 231 and the second light emitting portion 232 may be configured to emit the same amount of light, the configuration may not be limited thereto. For example, the first light emitting portion 231 and the second light emitting portion 232 may be configured to emit different amounts of light as illustrated in FIG. 6.

Unlike the light emitting portions of FIG. 6, the first light emitting portion 231 may emit light when the second connection end portion 222 is connected with the supporting unit 240, and the second light emitting portion 232 may emit light when the first connection end portion 221 is connected with the supporting unit 240. A lighting operation of the plurality of light emitting members 230 corresponding to the first light emitting portion 231 and the second light emitting portion 232 will be described in detail.

The supporting unit 240 may be configured to include a supporting recess 241 to which the first connection end portion 221 and the second connection end portion 222 of the body 220 are inserted, so as to support the lighting unit 210. The configuration of the supporting unit 240 may be the same as the supporting unit 40 of FIGS. 1 through 5 and the supporting unit 140 of FIG. 6, detailed descriptions thereof will be omitted.

Referring to FIG. 7, a light angle, a light direction, and an elevation of light associated with light emitted from the plurality of light emitting members 230 may vary based on a posture of connection between the body 220 of the lighting unit 210 with the supporting unit 240. Particularly, when the first connection end portion 221 of the lighting body 220 is inserted into the supporting recess 241, the second light emitting portion 232 may emit light. When the posture of the body varies and the second connection end portion 222 is inserted into the supporting recess 241, the first light emitting portion 231 may emit light. In this example, when the second light emitting portion 232 emits light, an elevation of light may be relatively higher than when the first light emitting portion 231 emits light. Also, the first light emitting portion 231 emits light to a location that is relatively father than a location to which the second light emitting portion 232 emits light, based on a location where the supporting unit 240 is mounted.

Even though the example embodiments of FIGS. 1 through 7 do not include a separate unit for fixing a state of the supporting unit supporting the lighting unit of the variable lighting apparatus, the configuration may not be limited thereto. The configuration of fixing the lighting unit and the supporting unit will be variably changed. For example, a magnet may be mounted in a plurality of connection end portions included in the lighting unit and in an internal surface of the supporting recess, so as to induce mutual attractive forces. Here, the variable lighting apparatus may change lighting conditions by changing a connection posture of the lighting unit with respect to the supporting unit so that a single lighting apparatus may provide various functions appropriate for various environments.

The variable lighting apparatus may be economical since the user may adjust a light angle, a light direction, an elevation of light, and an amount of light based on environmental conditions.

The lighting unit may be connected with the supporting unit based on a contact point connection scheme, and may receive power for lighting so that the variable lighting apparatus may not include a complex power providing line and may have an advantage in terms of design.

The variable lighting apparatus may include an LED and thus, may provide an eco-friendly and economical lighting apparatus.

Although a few embodiments of the present invention have been shown and described, the present invention is not limited to the described embodiments. Instead, it would be appreciated by those skilled in the art that changes may be made to these embodiments without departing from the principles and spirit of the invention, the scope of which is defined by the claims and their equivalents.

What is claimed is:

1. A variable lighting apparatus, comprising:

a lighting unit configured to emit light and comprising a first connection member and a second connection member of which a first end of the second connection member is connected to a first end of the first connection member; and a supporting unit comprising a supporting recess configured to selectively connect to one of a second end of the first connection member and a second end of the second connection member and provide power to the connected lighting unit such that each of the first and second connection members is selectively in direct contact with the supporting recess, wherein the first connection member and the second connection member are configured to independently emit amounts of light different from each other, and the lighting unit, when the second end of the first connection member connects to the supporting recess, emits an amount of light different from an amount of light of the lighting unit when the second end of the second connection member connects to the supporting recess.

2. The apparatus of claim 1, wherein:

the first connection member includes a first contact point for connecting with the supporting recess, and the second connection member extends in a different direction from the first connection member and includes a second contact point for connecting with the supporting recess, and the lighting unit further comprises a third connection member that extends in a different direction from the first connection member and the second connection member and includes a third contact point for connecting with the supporting recess; and the lighting unit further comprises a first light emitting portion, a second light emitting portion, and a third light emitting portion disposed on the first connection member, the second connection member, and the third connection member, respectively, to independently emit light based on power provided from the first contact point, the second contact point and the third contact point, respectively.

3. The apparatus of claim 1, wherein:

the lighting unit comprises a plurality of connection members including the first and second connection members, and the lighting unit comprises a plurality of light emitting members configured to independently emit an amount of light identical to one another or amounts of light different from each other, based on a corresponding connection between the plurality of connection members and the supporting recess.

* * * * *